US006266828B1

(12) United States Patent
Corsini

(10) Patent No.: US 6,266,828 B1
(45) Date of Patent: Jul. 31, 2001

(54) INTEGRATED FACEMASK FIREFIGHTING HOOD

(76) Inventor: Ralph Corsini, 5 Mackay Rd., Bay Shore, NY (US) 11706

( * ) Notice: Subject to any disclaimer, the term of this patent is extended or adjusted under 35 U.S.C. 154(b) by 0 days.

(21) Appl. No.: 09/503,471

(22) Filed: Feb. 14, 2000

Related U.S. Application Data

(60) Provisional application No. 60/172,666, filed on Dec. 20, 1999.

(51) Int. Cl.[7] ..... A42B 1/04; A42B 3/18

(52) U.S. Cl. ..... 2/424; 2/5; 2/8; 2/202

(58) Field of Search ..... 2/424, 5, 202, 2/6.3, 7, 8, 10, 205, 206, 427, 9; 128/201.22, 201.23, 201.24, 201.25, 202.13, 202.19, 202.27, 205.22, 206.21, 206.23, 206.24, 206.27, 206.28

(56) References Cited

U.S. PATENT DOCUMENTS

| | | | | |
|---|---|---|---|---|
| D. 261,073 | | 10/1981 | Spruill et al. | D2/232 |
| 456,687 | * | 7/1891 | Bader | 2/5 |
| 1,079,251 | * | 1/1913 | Macrini | 2/5 |
| 1,095,089 | * | 4/1914 | Dinn | 2/424 |
| 1,251,657 | * | 1/1918 | Hart . | |
| 2,105,028 | * | 1/1938 | Dickhoff | 2/3 |
| 2,870,451 | * | 1/1959 | Bordsky | 2/202 |
| 3,098,233 | * | 7/1963 | Hoagland | 2/424 |
| 3,535,706 | * | 10/1970 | Aileo | 2/5 |
| 3,911,914 | * | 10/1975 | Johansson | 2/424 |
| 4,183,101 | * | 1/1980 | Melander | 2/424 |
| 4,184,212 | * | 1/1980 | Bowman | 2/5 |
| 4,573,217 | * | 3/1986 | Reed | 2/5 |
| 4,768,235 | * | 9/1988 | Webster | 2/202 |
| 4,870,959 | * | 10/1989 | Reisman et al. | 2/7 |
| 4,972,520 | | 11/1990 | Grilliot et al. | 2/5 |
| 4,975,980 | * | 12/1990 | Ersteniuk | 2/5 |
| 5,181,506 | * | 1/1993 | Tardiff, Jr. et al. | 128/201.22 |
| 5,431,156 | | 7/1995 | Sundstrom | 128/201 |
| 5,555,569 | | 9/1996 | Lane | 2/424 |
| 5,628,065 | | 5/1997 | Austin | 2/81 |
| 5,653,225 | | 8/1997 | Schegerin | 128/201.24 |
| 5,704,073 | * | 1/1998 | Sword et al. | 2/427 |
| 6,006,360 | | 12/1999 | Reed | 2/202 |

FOREIGN PATENT DOCUMENTS

| | | | | |
|---|---|---|---|---|
| 319511 | * | 9/1929 | (GB) | 2/5 |

OTHER PUBLICATIONS

Scott's AV–HOOD advertisement in Fire Engineering magazine, Dec. 1999 issue (2pages).
Photograph of a Protective Hood Accessory, Fire Brigade Mfg., Inc., date of manufacture: Aug. 1999 (1 page).
Printout of Information on NOMEX material from Du Pont's website, Dec. 13, 2000 (4 pages).

* cited by examiner

*Primary Examiner*—Amy B. Vanatta

(57) ABSTRACT

A firefighting hood and facemask combination removably fastened together.

5 Claims, 2 Drawing Sheets

INTEGRATED FACEMASK FIREFIGHTING HOOD

CROSS-REFERENCE TO RELATED APPLICATIONS

This Application derives priority from U.S. Provisional Application Ser. No. 60/172,666, filed Dec. 20, 1999.

BACKGROUND OF THE INVENTION

1. Field of the Invention

This invention pertains to the field of firefighter safety equipment. Firefighters wear fire resistant protective hoods. The hood protects the ears, cheeks and neck of a firefighter when properly worn.

2. Description of the Prior Art

The current procedure for wearing most protective hoods and facemasks, is as follows:

Most protective hoods are staged for use by putting one's head through the neck opening of the hood, then putting one's head through the face opening, thus positioning the face opening of the hood around one's neck and under the fire fighter's protective coat. When needed, the facemask is then donned and the hood is pulled over the head with the intention of covering the ears, cheeks and neck of the firefighter.

This current procedure has the following problems:

1. The firefighter pulls the hood over his head sometimes not covering all of his ears, cheeks and neck.
2. The hood sometimes is pulled too far over the top of one's head, restricting visibility through the facemask sight window.
3. Often the fire fighter is pressed for time and forgets to put on his hood.
4. The hood, being positioned under the collar of the protective coat, creates a gap between the neck and the coat, catching hot, falling debris that can burn the back of the firefighter's neck.

BRIEF SUMMARY OF THE INVENTION

This invention integrates the firefighter's facemask with the protective hood. It works in the following manner: Around the perimeter of the facemask opening of the hood are fasteners which are releasable from and compatible with the fasteners located around the perimeter of the sight window of the facemask. The hood is attached to the facemask via the fasteners. The hood is then pulled forward over the facemask, turning it inside out, thus covering the sight window. This is called the staged position. When needed, the facemask is donned and the hood is pulled back over the head, neck and coat collar, thus exposing the facemask sight window.

The integrated facemask firefighting hood has the following advantages:

1. The integrated facemask firefighting hood eliminates the gap between the neck and coat collar by overlapping the coat collar.
2. The integrated facemask firefighting hood, being fastened to the perimeter of the facemask, assures the firefighter of covering all of one's ears, cheeks and neck, and does not allow debris to enter the facemask.
3. The integrated facemask firefighting hood being fastened to the perimeter of the facemask assures the firefighter of full visibility through the facemask sight window.
4. The integrated facemask firefighting hood in the staged position the protects the facemask sight window from being scratched.

5. The integrated facemask firefighting hood is faster and easier to put on, and eliminates hood wearing errors.
6. The integrated facemask firefighting hood being fastened to the facemask, eliminates the need for the fire fighter to remember to put the hood on, because if not put on, it would completely restrict one's visibility.

DETAILED DESCRIPTION OF THE INVENTION

Figure 1:
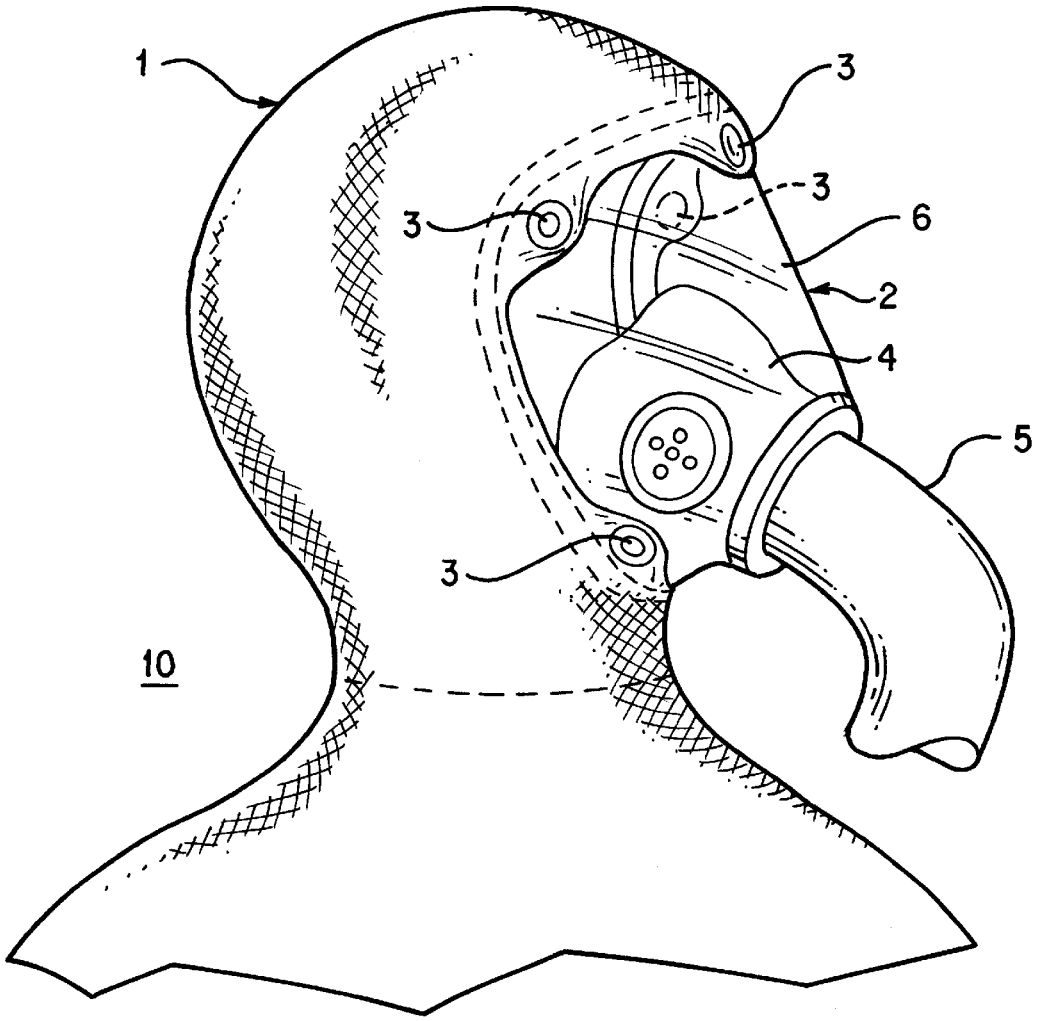
FIG. 1 is a side view of the integrated facemask firefighting hood of the present invention, illustrating the hood, the facemask and the fasteners.

The integrated facemask firefighting hood 10 is shown in FIG. 1. The hood 1 is constructed of thermal barrier or thermal insulation material and is customarily comprised of a plurality of layers of thermal barrier or thermal insulation material. When worn, the integrated facemask firefighting hood 10 covers firefighter's ears, cheeks and neck. The hood 1 of the integrated facemask firefighting hood 10 has a front opening to receive the firefighter's facemask 2 having a sight window 6. Mounted around the perimeter of the hood's facemask-opening are fasteners 3. Compatible fasteners 3 are mounted around the perimeter of the firefighting facemask 2, and are removably attached to the hood 1.

Reference numeral 4 represents a breathing regulator for regulating air inside the firefighting facemask.

Figure 2:
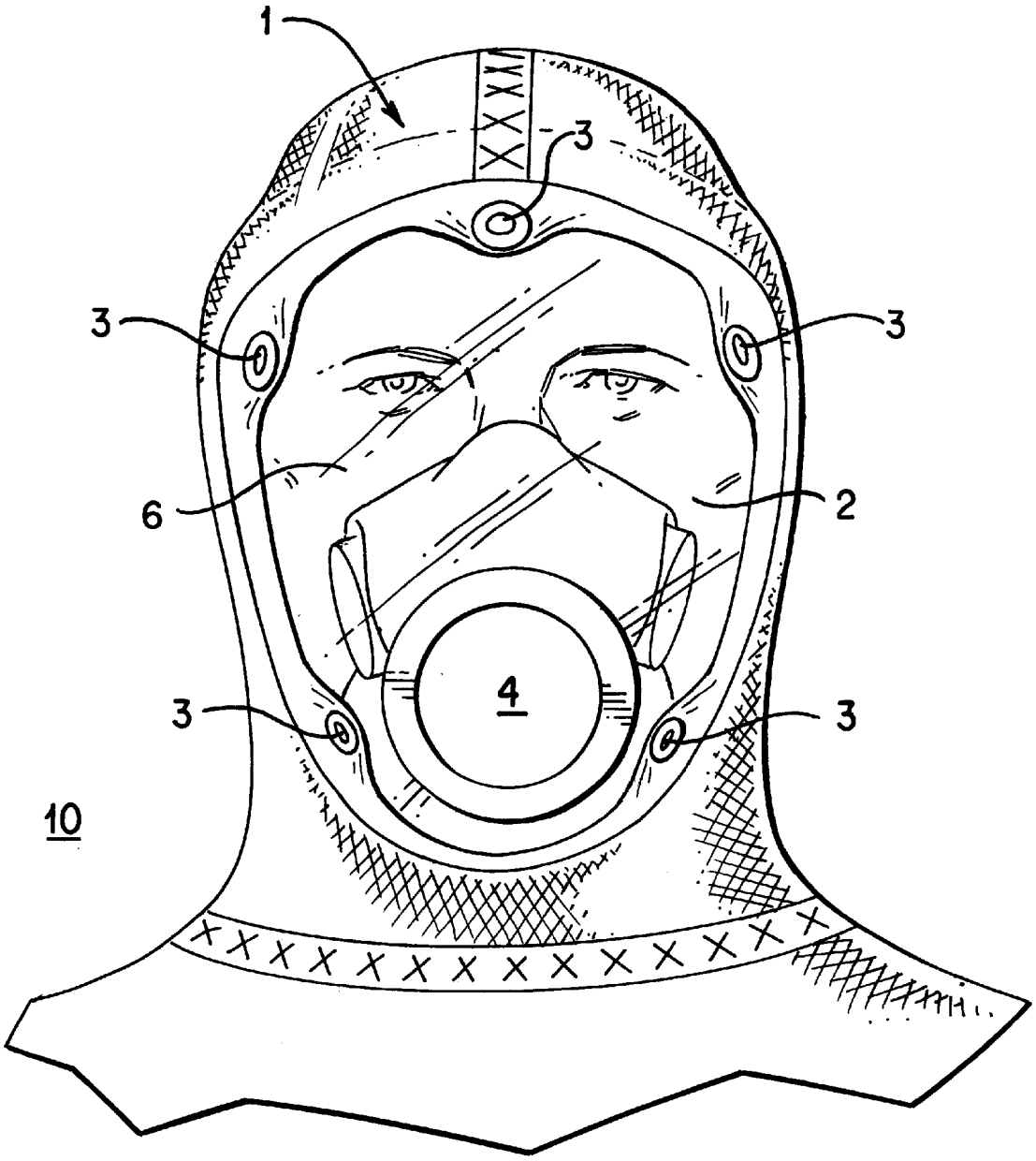
FIG. 2 is a front view of the integrated facemask firefighting hood of the present invention.

Reference numeral 5 represents a hose for supplying air to a breathing regulator 4 via a front opening in the facemask 2. FIG. 2 is a front view of the integrated facemask firefighting hood invention, illustrating the hood 1, the facemask 2 and its hose opening, the fasteners 3 and the breathing regulator 4.

What is claimed is:

1. A safety apparatus for protecting the head, neck and face of a firefighter, said apparatus comprising:

a) a facemask having a sight window for providing visibility to the firefighter and in contact with the firefighter's face around the facemask's perimeter, said facemask being secured directly to the firefighter's head and covering at least a portion of the firefighter's face;

b) a hood made of a flexible fire resistant material for covering the firefighter's head and neck, said hood having a continuous face opening; and c) an attachment mechanism providing for removable attachment of said hood to said facemask in the area of said face opening, such that when said hood is attached to said facemask, said hood partially overlaps an exterior surface of said facemask along a perimeter of said face opening and together said hood and said facemask cover the firefighter's head, neck and face.

2. The safety apparatus of claim 1, further comprising a breathing regulator attached to said facemask for providing regulated air pressure on an interior of said facemask.

3. The safety apparatus of claim 2, further comprising a hose connected to said breathing regulator for delivering air to said breathing regulator.

4. The safety apparatus of claim 3, wherein said attachment mechanism comprises a plurality of fasteners.

5. A safety device for protecting the head, neck and face of a firefighter, said safety device comprising:

a) a facemask having a sight window for providing visibility to the firefighter and in contact with the firefighter's face, said facemask being secured to the firefighter's head and covering at leas, a portion of the firefighter's face, said facemask having a front opening in said sight window;

b) a breathing regulator attached to said facemask or providing regulated air pressure to an interior of said facemask;

c) a hose connected to said breathing regulator for delivering air to said breathing regulator via the front opening in said sight window of said facemask;

d) a hood made of a flexible fire resistant material for covering the firefighter's head and neck, said hood having a continuous face opening; and e) an attachment mechanism providing for removable attachment of said hood to said facemask in the area of said face opening; whereby, when said hood is attached to said facemask, said hood partially overlaps an exterior surface of said facemask along a perimeter of said face opening and together said hood and said facemask cover the firefighter's head, neck and face.

* * * * *